US010040167B2

(12) United States Patent
Chen et al.

(10) Patent No.: US 10,040,167 B2
(45) Date of Patent: Aug. 7, 2018

(54) POLISHING PAD, POLISHING SYSTEM AND POLISHING METHOD

(71) Applicant: IV Technologies CO., Ltd., Taichung (TW)

(72) Inventors: Ko-Wen Chen, Taichung (TW); Shih-Ming Yu, Taipei (TW)

(73) Assignee: IV Technologies CO., Ltd., Taichung (TW)

( * ) Notice: Subject to any disclaimer, the term of this patent is extended or adjusted under 35 U.S.C. 154(b) by 121 days.

(21) Appl. No.: 15/224,676

(22) Filed: Aug. 1, 2016

(65) Prior Publication Data

US 2017/0036319 A1 Feb. 9, 2017

(30) Foreign Application Priority Data

Aug. 7, 2015 (TW) ..... 104125816 A

(51) Int. Cl.
*B24B 37/20* (2012.01)
*B24B 37/22* (2012.01)

(52) U.S. Cl.
CPC ..... *B24B 37/22* (2013.01)

(58) Field of Classification Search
CPC ..... B24B 37/22
USPC ..... 451/41, 526–539, 285–290
See application file for complete search history.

(56) References Cited

U.S. PATENT DOCUMENTS 4,504,283 A * 3/1985 Charvat ..... B24D 13/00 451/526
5,639,388 A * 6/1997 Kimura ..... B24B 37/013 216/84
5,674,109 A * 10/1997 Kanzawa ..... B24B 37/042 451/285
5,851,846 A * 12/1998 Matsui ..... H01L 21/31053 216/52
6,648,743 B1 * 11/2003 Burke ..... B24B 37/26 451/526
6,783,436 B1 * 8/2004 Muldowney ..... B24B 37/26 451/41
6,974,372 B1 * 12/2005 Muldowney ..... B24B 37/26 451/527
7,503,833 B2 * 3/2009 Muldowney ..... B24B 37/24 451/287
8,398,456 B2 * 3/2013 Kobayashi ..... B24B 49/00 451/285

(Continued)

FOREIGN PATENT DOCUMENTS

TW 201302387 1/2013
TW M459065 8/2013
TW I449597 8/2014

*Primary Examiner* — George Nguyen
(74) *Attorney, Agent, or Firm* — JCIPRNET

(57) ABSTRACT

A polishing pad is provided. The polishing pad includes a polishing layer, which includes a central region, a peripheral region, and a main polishing region located between the central region and the peripheral region. At least one annular groove is located in the main polishing region of the polishing layer. A peripheral groove is located in the peripheral region, and the peripheral groove includes grid-shaped grooves. At least one radial extending groove is located in the main polishing region of the polishing layer, and the at least one radial extending groove is connected with the at least one annular groove. A polishing system including the polishing pad and a polishing method using the polishing pad are provided.

25 Claims, 7 Drawing Sheets

(56) References Cited

U.S. PATENT DOCUMENTS

| | | | | |
|---|---|---|---|---|
| 8,398,461 | B2 * | 3/2013 | Wang | B24B 37/26 451/285 |
| 8,870,626 | B2 * | 10/2014 | Wang | B24B 37/30 451/285 |
| 9,409,276 | B2 * | 8/2016 | Tsai | B24B 37/26 |
| 2001/0005665 | A1 * | 6/2001 | Hempel | B24B 37/20 451/41 |
| 2003/0073393 | A1 * | 4/2003 | Noguchi | B24D 7/14 451/285 |
| 2004/0014413 | A1 * | 1/2004 | Kawahashi | B24B 37/26 451/527 |
| 2004/0166773 | A1 * | 8/2004 | Tada | B24B 37/005 451/8 |
| 2006/0094345 | A1 * | 5/2006 | Ito | B24B 37/26 451/458 |
| 2006/0270325 | A1 * | 11/2006 | Choi | B24B 37/26 451/285 |
| 2012/0196512 | A1 * | 8/2012 | Shirasu | B24B 37/042 451/41 |
| 2013/0324020 | A1 * | 12/2013 | Lefevre | B24B 37/205 451/529 |
| 2014/0170943 | A1 * | 6/2014 | Takeuchi | B24B 37/22 451/527 |
| 2015/0343596 | A1 * | 12/2015 | Kimura | B24B 37/26 438/692 |
| 2016/0375544 | A1 * | 12/2016 | Kozhukh | H01L 21/3212 216/38 |
| 2017/0120417 | A1 * | 5/2017 | Lefevre | B24B 37/22 |

* cited by examiner

POLISHING PAD, POLISHING SYSTEM AND POLISHING METHOD

CROSS-REFERENCE TO RELATED APPLICATION

This application claims the priority benefit of Taiwan application serial no. 104125816, filed on Aug. 7, 2015. The entirety of the above-mentioned patent application is hereby incorporated by reference herein and made a part of this specification.

BACKGROUND OF THE INVENTION

Field of the Invention

The invention relates to a polishing pad and a polishing system and particularly relates to a polishing pad, a polishing system, and a polishing method that achieve a relatively uniform removal rate.

Description of Related Art

With the advancement of industries, planarizing processes are often used as processes for manufacturing various devices. Among the planarizing processes, chemical mechanical polishing is commonly used by the industries. Generally, the chemical mechanical polishing (CMP) process is carried out by attaching a polishing pad to a polishing platen, supplying a slurry which contains chemicals on the polishing pad, applying a pressure on the object to be polished (e.g., semiconductor wafer) to press it against the polishing pad, and then moving the object to be polished and the polishing pad relative to each other. Through the mechanical friction generated by the relative movement and the chemical reaction of the slurry, a part of the surface of the object is removed to gradually planarize the surface, thereby achieving the purpose of planarization.

FIG. 1A is a schematic top view of a conventional polishing pad. Referring to FIG. 1A, a polishing pad 10A includes a plurality of concentric grooves 14 that are formed on a surface of a polishing layer 12 of the polishing pad 10A for accommodating and transporting a slurry. However, the concentric grooves 14 are not connected with one another, so the transportation of the slurry is not good enough between different regions of the surface of the polishing layer 12. Particularly, the slurry flow distribution in the region corresponding to the center region of an object to be polished 20 may be not good enough and result in a non-uniform removal rate of the object to be polished 20.

FIG. 1B is a schematic top view of another conventional polishing pad. Referring to FIG. 1B, a surface of a polishing layer 12 of a polishing pad 10B further has grid-shaped grooves 16 thereon in addition to the multiple concentric grooves 14. The grid-shaped grooves 16 are connected in order to improve the efficiency of transportation of the slurry. For specific polishing processes, however, it may have too much slurry flow distributed in the region corresponding to the center region of the object to be polished 20. As a result, the problem of non-uniform removal rate still exists.

In view of the above, for specific polishing processes, a polishing pad having different slurry flow distribution is required in order to meet the demands of the industries.

SUMMARY OF THE INVENTION

The invention provides a polishing pad, a polishing system, and a polishing method having a different slurry flow distribution to achieve a relatively uniform removal rate.

The polishing pad of the invention includes a polishing layer that includes a central region, a peripheral region, and a main polishing region located between the central region and the peripheral region. At least one annular groove is located in the main polishing region of the polishing layer. A peripheral groove is located in the peripheral region of the polishing layer, and the peripheral groove includes a grid-shaped groove. At least one radial extending groove is located in the main polishing region of the polishing layer, and the at least one radial extending groove is connected with the at least one annular groove.

The invention further provides a polishing system that includes a polishing pad and an object to be polished. The polishing pad includes a polishing layer that includes a central region, a peripheral region, and a main polishing region located between the central region and the peripheral region. At least one annular groove is located in the main polishing region of the polishing layer. A peripheral groove is located in the peripheral region of the polishing layer, and the peripheral groove includes a grid-shaped groove. At least one radial extending groove is located in the main polishing region of the polishing layer, and the at least one radial extending groove is connected with the at least one annular groove. The object to be polished is disposed on the polishing pad and includes an inner region and an periphery region encircling the inner region. In a polishing process, the inner region of the object to be polished is in contact with the at least one annular groove and the at least one radial extending groove of the polishing layer, and the periphery region of the object to be polished is in contact with the at least one annular groove, the peripheral groove, and the at least one radial extending groove of the polishing layer.

The invention further provides a polishing method that includes: providing the polishing pad; providing an object to be polished, which includes an inner region and an outer region encircling the inner region, on the polishing pad; and applying a pressure on the object to be polished to press the object to be polished against the polishing pad to perform a polishing process. In the polishing process, the object to be polished is moving relative to the polishing pad.

Based on the above, through special configuration of the annular groove, the peripheral groove, and the radial extending groove, it enables the slurry to have a different flow distribution, such that a relatively uniform removal rate may be achieved for the specific polishing process.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1A:
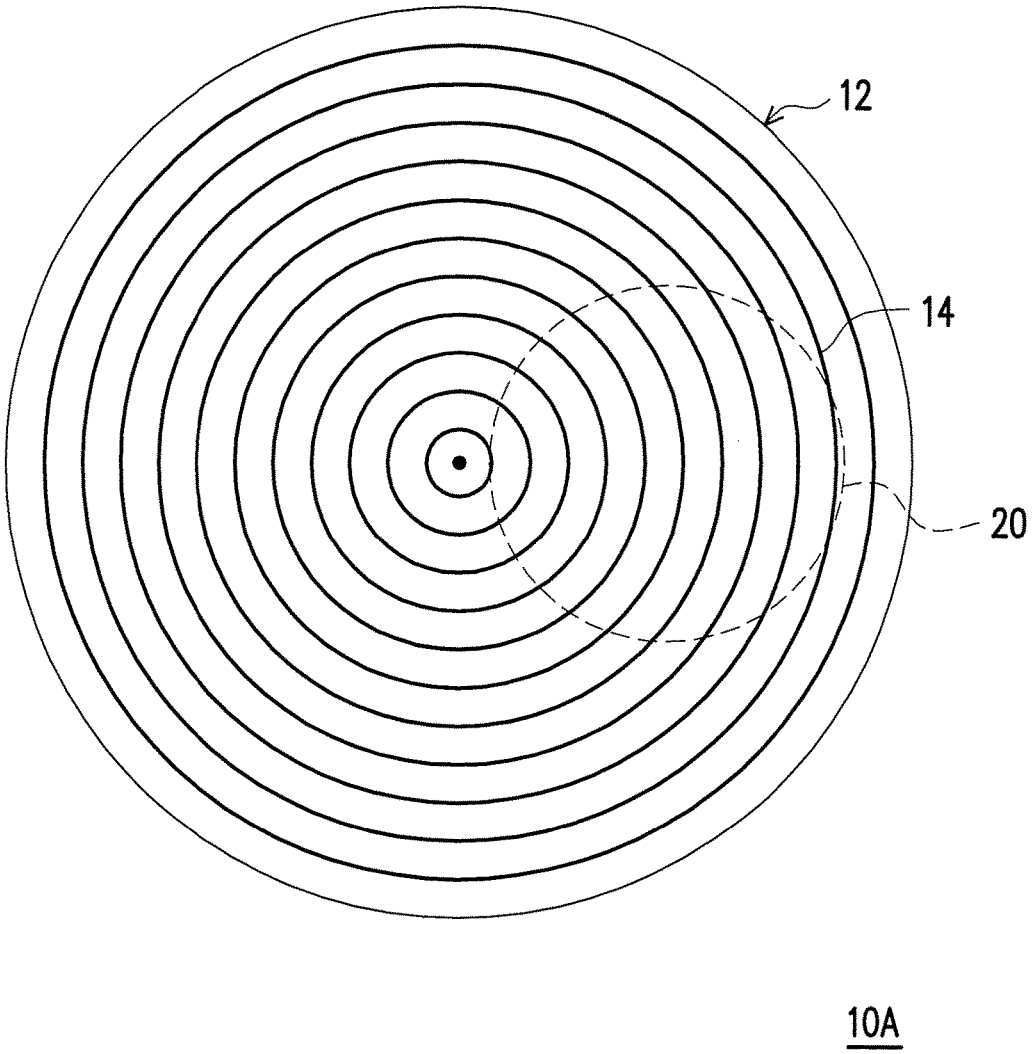
FIG. 1A to FIG. 1B are schematic top views of the conventional polishing pads and objects to be polished.
Figure 1B:
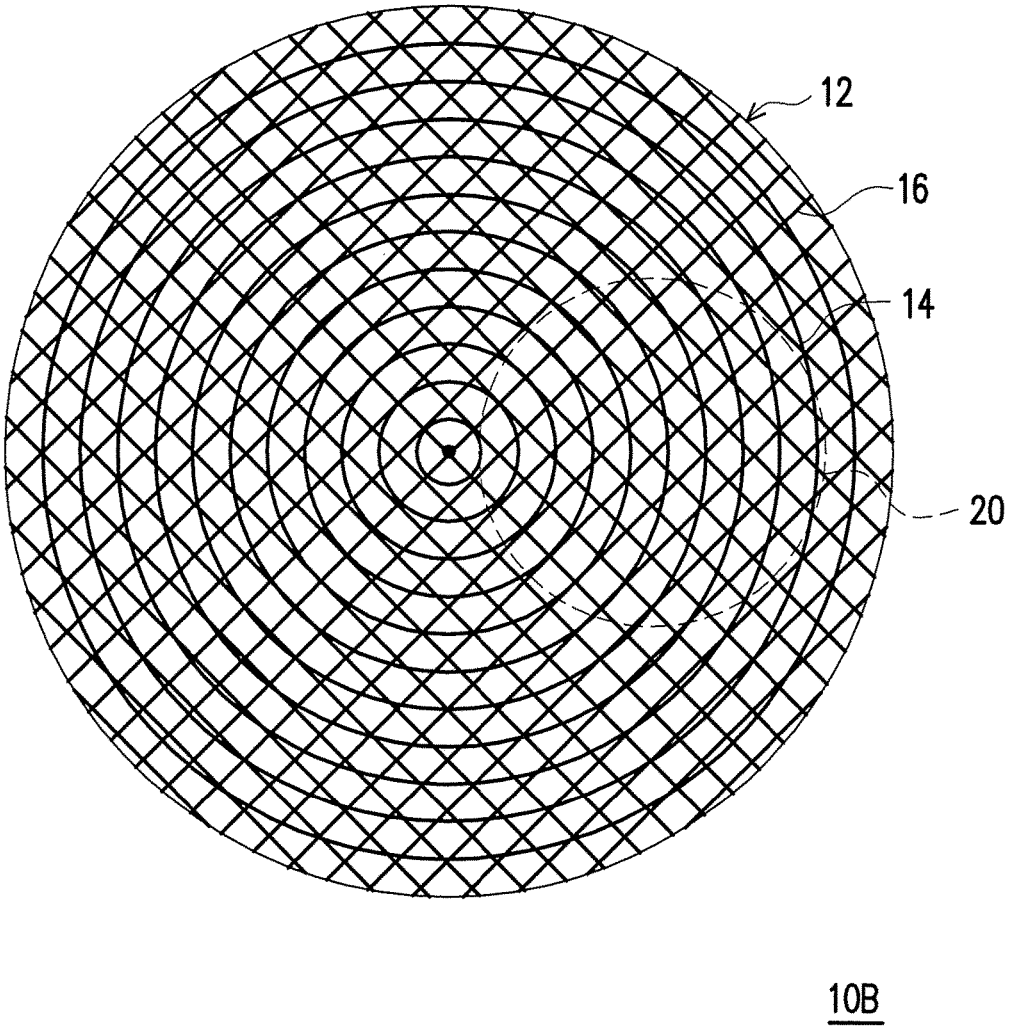
Figure 2:
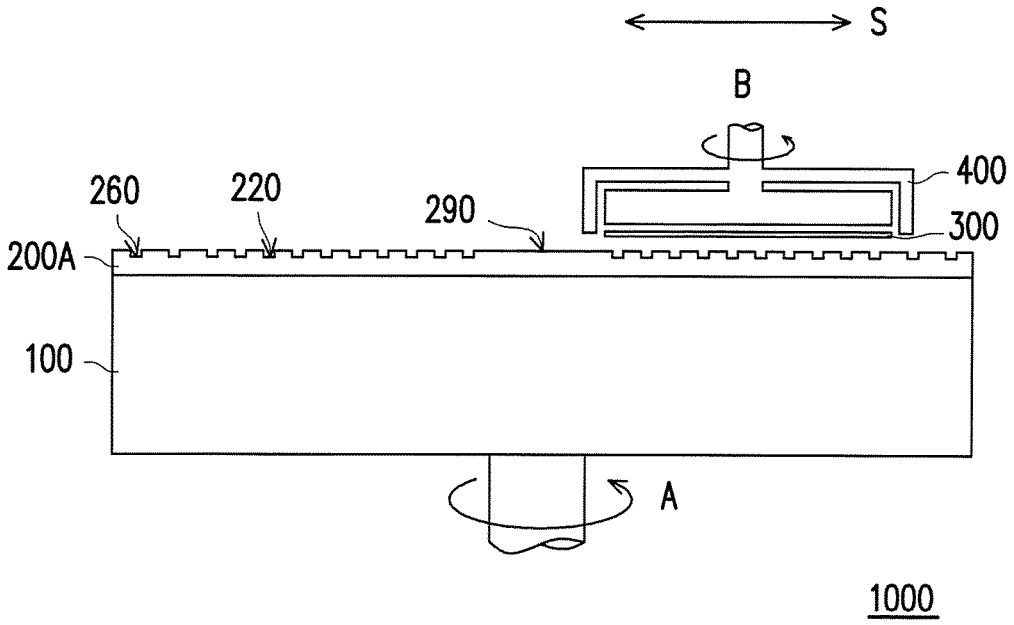
FIG. 2 is a schematic cross-sectional view of a polishing system according to an embodiment of the invention.
Figure 3:
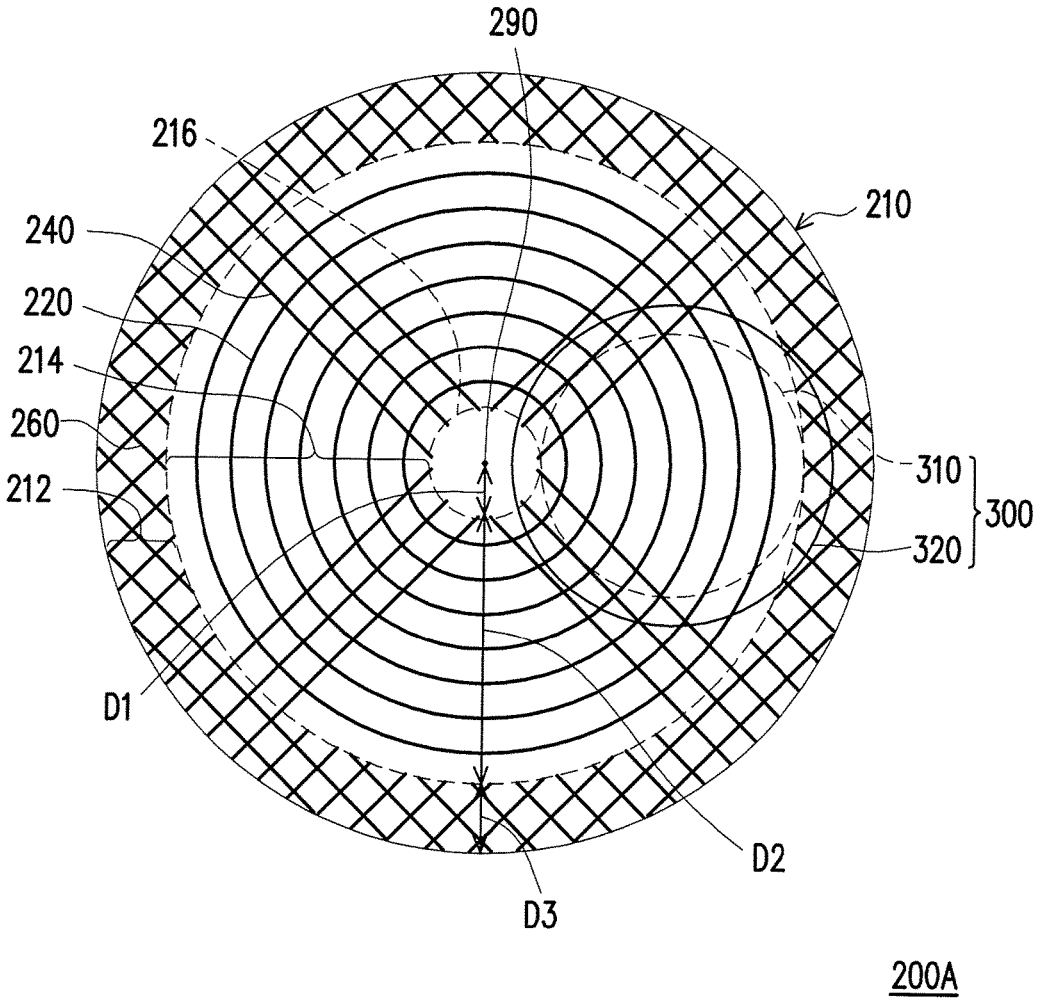
FIG. 3 is a schematic top view of a polishing pad and an object to be polished according to the embodiment of FIG. 2.

FIG. 2 is a schematic cross-sectional view of a polishing system according to an embodiment of the invention. FIG. 3 is a schematic top view of a polishing pad and an object to be polished according to the embodiment of FIG. 2. Referring to FIG. 2, a polishing system 1000 includes a platen 100, a polishing pad 200A, an object to be polished 300, and a polishing head 400. The platen 100 carries the polishing pad 200A, for example.

Referring to FIG. 2 and FIG. 3, the polishing pad 200A of this embodiment is disposed on the platen 100. The polishing pad 200A includes a polishing layer 210, at least one annular groove 220, at least one radial extending groove 240, and a peripheral groove 260. The polishing pad 200A further includes a rotation center 290.

The polishing layer 210 includes a central region 216, a peripheral region 212, and a main polishing region 214 located between the central region 216 and the peripheral region 212. The rotation center 290 is located at a center position of the polishing layer 210.

The annular groove 220 is located in the main polishing region 214 of the polishing layer 210. In this embodiment, the annular groove 220 includes a plurality of annular grooves that are arranged concentrically around the rotation center 290 (as shown in FIG. 3). Nevertheless, the invention is not limited thereto. The number of the annular grooves 220 is not particularly limited, which may be one or more. For example, one single spiral annular groove or multiple circular annular grooves may be formed depending on the actual requirements.

The peripheral groove 260 is located in the peripheral region 212 of the polishing layer 210. The peripheral groove 260 includes a grid-shaped groove, which may have a shape of a quadrilateral grid (e.g., square grid, rectangular grid, rhombic grid, and trapezoidal grid), a triangular grid, a polygonal grid, or a combination of the foregoing, for example. Nevertheless, the invention is not limited thereto. Specifically, the grid-shaped groove is formed by crossing two or more groups of grooves that are parallel to one another or not connected with one another, and the two or more groups of grooves that are parallel to one another or not connected with one another are lined grooves or curved grooves (e.g., arc grooves or annular grooves), for example. Nevertheless, the invention is not limited thereto. The grid-shaped groove shown in FIG. 3 has a shape formed by crossing two groups of parallel lined grooves that are perpendicular to each other, for example.

The radial extending groove 240 is located in the main polishing region 214 of the polishing layer 210 and is connected with the annular groove 220. In the invention, the radial extending groove 240 refers to a groove that extends across different radial positions in the polishing layer 210 and is not necessarily a groove in a radial direction. The radial extending groove 240 may also be a groove that is parallel to the radial direction or forms an angle with the radial direction. The radial extending groove 240 may be a lined groove, a curved groove, an irregular groove, or a combination of the foregoing. In an embodiment, the radial extending groove 240 extends to the peripheral region 212 and is connected with the peripheral groove 260, for example. Moreover, the radial extending groove 240 may be an extension of a portion of the grid-shaped groove of the peripheral groove 260. The number of the radial extending grooves 240 is not particularly limited, which may be one or more depending on the actual requirements. The radial extending groove 240 is an extension of a portion of the grid-shaped groove, which is close to the rotation center 290 after being extended. The radial extending groove 240 includes one, two, or more groups of grooves that are parallel, not parallel, or connected with one another, for example. The one, two, or more groups of grooves that are parallel, not parallel, or connected with one another are lined grooves, curved grooves (e.g., arc grooves), irregular grooves, or a combination of the foregoing, for example. Nevertheless, the invention is not limited thereto. According to the invention, the radial extending groove 240 is at least located in the main polishing region 214 of the polishing layer 210 and is connected with the annular groove 220. In other words, the radial extending groove 240 may extend to the central region 216 and/or the peripheral region 212 or not, depending on the actual requirements. Moreover, any groove in each group of the radial extending grooves 240 may pass through the rotation center 290 or not, depending on the actual requirements. The radial extending groove 240 shown in FIG. 3 includes four groups of parallel lined grooves, for example, wherein virtual extension lines of the two groups of grooves spaced in a circumferential direction are connected in parallel, and virtual extension lines of the two groups of grooves adjacent in the circumferential direction are connected perpendicularly. The radial extending groove 240 of FIG. 3 only extends to the peripheral region 212 and does not extend to the central region 216. A portion of the virtual extension lines (the middle groove of each group) of the radial extending grooves 240 toward the central region 216 pass through the rotation center 290 while the other portions (peripheral two grooves of each group) do not pass through the rotation center 290.

In the radial direction of the polishing layer 210, the central region 216 has a first width D1, the main polishing region 214 has a second width D2, and the peripheral region 212 has a third width D3, as shown in FIG. 3. The first width D1 is 5%-25% of a radius of the polishing layer 210, the second width D2 is 50%-90% of the radius of the polishing layer 210, and the third width D3 is 5%-25% of the radius of the polishing layer 210.

The polishing layer 210 of the polishing pad 200A is composed of a polymer base material, for example, which may be polyester, polyether, polyurethane, polycarbonate, polyacrylate, polybutadiene, or other polymer base materials obtained by synthesizing suitable thermosetting resins or thermoplastic resins.

In an embodiment, a method of manufacturing the polishing layer 210 of the polishing pad 200A is as follows. First, a semifinished product of polishing layer is formed, for example, by molding or extrusion molding to obtain a sheet-like semifinished product of polishing layer, or by infusion to obtain a columnar semifinished product of polishing layer and then slicing the columnar semifinished product of polishing layer into a sheet-like semifinished product of polishing layer. Next, the semifinished product of polishing layer is cut into a size of the polishing layer by a cutting device, and then processes of forming grooves and bonding an adhesive layer to the back surface of the polishing layer 210 are performed to complete the polishing pad 200A. In addition, a buffer layer may be selectively disposed under the polishing layer 210 so as to complete the polishing pad 200A that meets different requirements.

The grooves in the polishing pad 200A are manufactured by a mechanical process (using a milling machine equipped with a drill or a saw blade, for example, which is to: fix the polishing layer on the milling processing machine, and rotate or horizontally move the drill or saw blade by moving the cutter on the machine so as to cut the polishing layer and form the grooves on the surface of polishing layer; or fix the polishing layer on a rotatable or horizontally movable machine and move the polishing layer on the machine to cut the polishing layer with a stationary cutter on the machine so as to form the grooves on the surface of polishing layer), a molded print transferring process, or an etching process (using chemical etching or laser processing, for example), for example. Nevertheless, the invention is not limited thereto.

In addition, a suction device (not shown) may be used in the process of manufacturing the grooves, wherein the suction device includes a vacuum suction device or an electrostatic suction device, and the suction device has a plurality of recessed parts respectively corresponding to the central region 216, the peripheral region 212, and the main polishing region 214 of the polishing layer 210. To meet the requirements for manufacturing different grooves in the regions of the polishing layer 210, the polishing pad 200A may be fixed by using the suction device, such that regions of the polishing layer 210 that are not yet to be processed are recessed due to the recessed parts of the suction device and are not cut by the cutter to form the grooves. Take manufacturing the peripheral groove 260 in the peripheral region 212 of the polishing layer 210 as an example, the central region 216 and the main polishing region 214 of the polishing layer 210 may be recessed downward by using the recessed parts of the suction device that correspond to the central region 216 and the main polishing region 214 of the polishing layer 210. Thus, the cutter only cuts the peripheral region 212 of the polishing layer 210 to form the peripheral groove 260 in the peripheral region 212 of the polishing layer 210. Based on this groove manufacturing method, each groove of the peripheral groove 260 that is not connected with the radial extending groove 240 has an end surface (close end point) on an outer side close to the main polishing region 214 and does not have an end surface (open end point) on an outer side close to the peripheral region 212. Nevertheless, the invention is not limited to the above. Patent No. TW-I449597 provides more details regarding the groove manufacturing method described above. Thus, the groove forming method disclosed in this patent is incorporated herein by reference.

Referring to FIG. 2, the polishing head 400 is disposed on the polishing pad 200A for fixing and holding the object to be polished 300 thereon. In an embodiment, the polishing head 400 has a membrane (not shown) and the object to be polished 300 is attached to an outer surface of the membrane, wherein the polishing head 400 controls an internal pressure of the membrane by inputting a gas into the membrane, so as to apply a pressure on the object to be polished 300 and press the object to be polished 300 against a surface of the polishing pad 200A, thereby a surface to be polished of the object to be polished 300 can contact with the polishing layer 210 of the polishing pad 200A for polishing. The object to be polished 300 may be a semiconductor wafer, a IIIV group wafer, a storage device carrier, a ceramic substrate, a polymer substrate, a glass substrate, and so on. Nevertheless, the invention is not limited thereto.

As shown in FIG. 2, when the platen 100 rotates in a rotational direction A, the polishing pad 200A attached to the surface of the platen 100 rotates in the same rotational direction A as the platen 100. The polishing head 400 rotates in a rotational direction B, and the object to be polished 300 attached to the polishing head 400 rotates in the same rotational direction B as the polishing head 400. In this embodiment, the rotational direction A is the same as the rotational direction B, for example, so it makes the polishing pad 200A and the object to be polished 300 to move relative to each other. Nevertheless, the invention is not limited thereto. In some other embodiments, the rotational direction A and the rotational direction B may be opposite directions to make the polishing pad 200A and the object to be polished 300 have opposite rotational motions. In an embodiment, when the polishing head 400 swings back and forth in a movement direction S, the object to be polished 300 attached to the outer surface of the membrane swings back and forth in the movement direction S as well for performing the polishing process.

Referring to FIG. 3, the object to be polished 300 is disposed on the polishing pad 200A and has an inner region 310 (i.e., center region) and an outer region 320 (i.e., periphery region) encircling the inner region 310. In the polishing process, the inner region 310 of the object to be polished 300 is in contact with the annular groove 220 and the radial extending groove 240 of the polishing layer 210, and the outer region 320 of the object to be polished 300 is in contact with the annular groove 220, the radial extending groove 240, and the peripheral groove 260 of the polishing layer 210. Moreover, in an embodiment, the object to be polished 300 has a radius (not shown), wherein a circular area within 70%-95% of the radius from the center of the object to be polished 300 is the inner region 310 and an annular area encircling the circular area is the outer region 320.

Referring to FIG. 2 and FIG. 3, in an embodiment, in a case where the object to be polished 300 does not swing back and forth in the polishing process, a location of the inner region 310 of the object to be polished 300 corresponds to the main polishing region 214 of the polishing layer 210 and a location of the outer region 320 of the object to be polished 300 corresponds to the peripheral region 212 of the polishing layer 210. Furthermore, the widths of the main polishing region 214, the peripheral region 212, and the central region 216 of the polishing layer 210 may be adjusted depending on the actual requirements, such that the location of the outer region 320 of the object to be polished 300 corresponds to the peripheral region 212 and the central region 216 of the polishing layer 210. In another embodiment, in a case where the object to be polished 300 swings back and forth (in the movement direction S as indicated in FIG. 2) in the polishing process, when the object to be polished 300 swings outward, the location of the outer region 320 corresponds to the peripheral region 212 of the polishing layer 210; and when the object to be polished 300 swings inward, the location of the outer region 320 corresponds to the central region 216 of the polishing layer 210.

In an embodiment, the radial extending groove 240 only occupies a portion of the main polishing region 214. For example, the radial extending groove 240 occupies 1%-50%, or 10%-30%, of the area of the main polishing region 214. Because the radial extending groove 240 connects the annular groove 220 in the main polishing region 214, the efficiency of transportation of the slurry is improved, such that the slurry corresponding to the inner region 310 of the object to be polished 300 has a moderate flow distribution. Moreover, the radial extending groove 240 extends to the peripheral region 212 or is connected with the grid-shaped groove of the peripheral groove 260, which is contributive to discharge by-products or debris generated in the polishing process from an edge of the polishing layer 210.

As described above, the polishing pad 200A of this embodiment includes at least one annular groove 220, at least one radial extending groove 240, and the peripheral groove 260. Because the annular groove 220, the radial extending groove 240, and the peripheral groove 260 are respectively located in different regions (e.g., the main polishing region 214 and the peripheral region 212) of the polishing layer 210 of the polishing pad 200A, this groove configuration causes the slurry to have a different flow distribution to achieve a relatively uniform removal rate.

Figure 4:
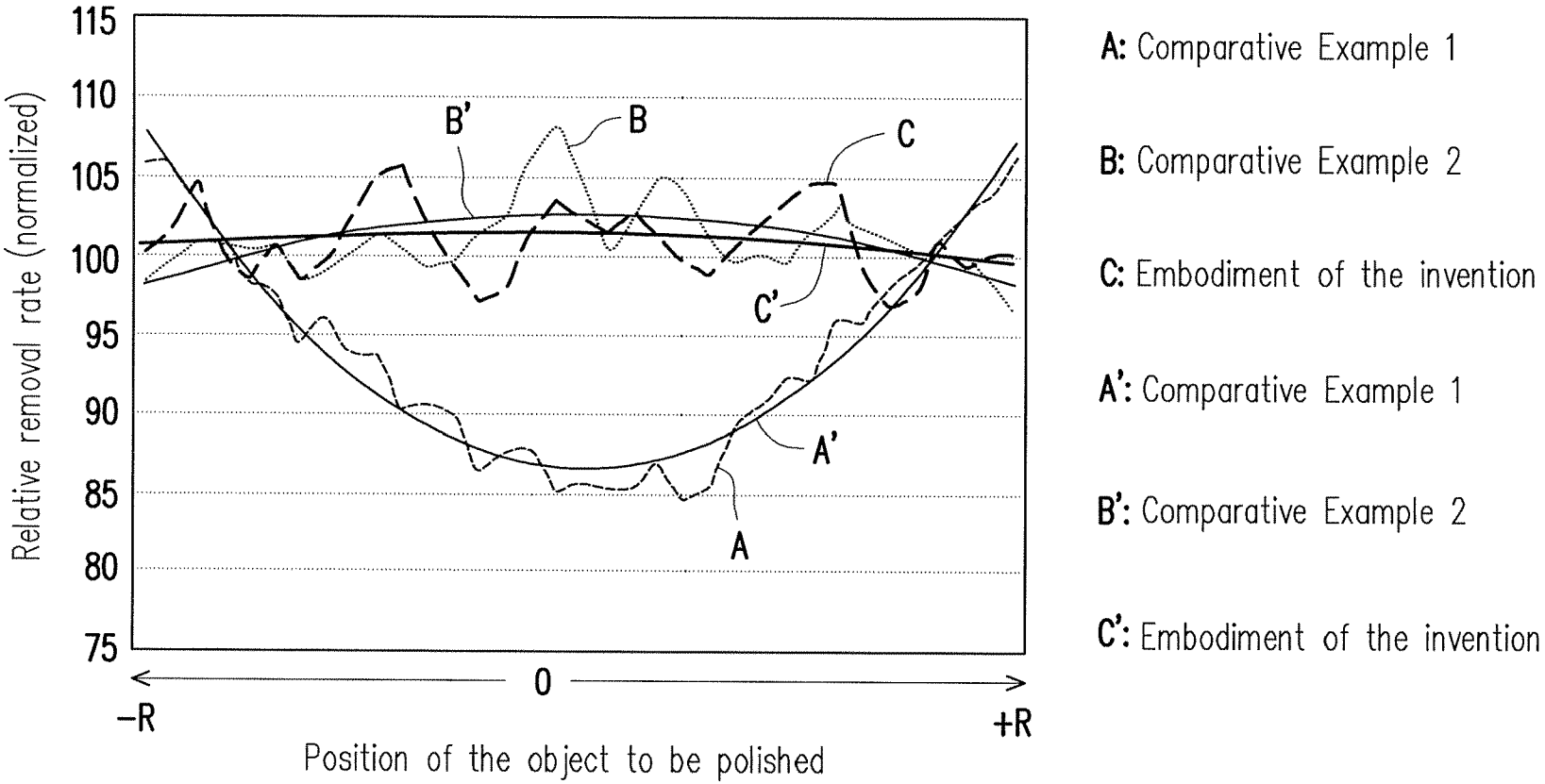
FIG. 4 is a chart showing comparison between relative removal rates of the polishing pad of the invention and the conventional polishing pads.

FIG. 4 is a chart showing comparison between relative removal rates of the polishing pad of the invention and the conventional polishing pads used in Cu CMP of Applied Materials Mirra tool, a polishing system generally adopted by industries. The vertical axis of FIG. 4 indicates the relative removal rate in a normalized way. That is, the relative removal rate of each point is represented based on an overall average removal rate, i.e., 100. The horizontal axis of FIG. 4 indicates a relative position of the object to be polished. That is, a relative position on the right with respect to the center of the object to be polished (i.e., a central position of the object to be polished is 0) is represented by +R and a relative position on the left is represented by −R. The dotted line A represents a polishing system using the conventional polishing pad that has concentric grooves, and the solid line A' is a trend line of the dotted line A; the dotted line B represents a polishing system using the conventional polishing pad that has concentric grooves and grid-shaped grooves, and the solid line B' is a trend line of the dotted line B; and the dotted line C represents a polishing system using the polishing pad of the invention, and the solid line C' is a trend line of the dotted line C. The conventional polishing pad having concentric grooves (the dotted line A) has an inferior slurry flow distribution corresponding to the center region of the object to be polished. Consequently, the relative removal rate of the center region of the object to be polished drops significantly, as indicated by the solid line A'. The other conventional polishing pad having concentric grooves and grid-shaped grooves (the dotted line B) has a better slurry flow distribution corresponding to the center region of the object to be polished. Thus, the relative removal rate of the center region of the object to be polished is slightly higher, as indicated by the solid line B'. The polishing pad of the invention (the dotted line C) has the special groove design and has a moderate slurry flow distribution corresponding to the center region of the object to be polished. Accordingly, the relative removal rate of the center region of the object to be polished is relatively flat and therefore the overall relative removal rate of the object to be polished is relatively uniform, as indicated by the solid line C'.

Figure 5:
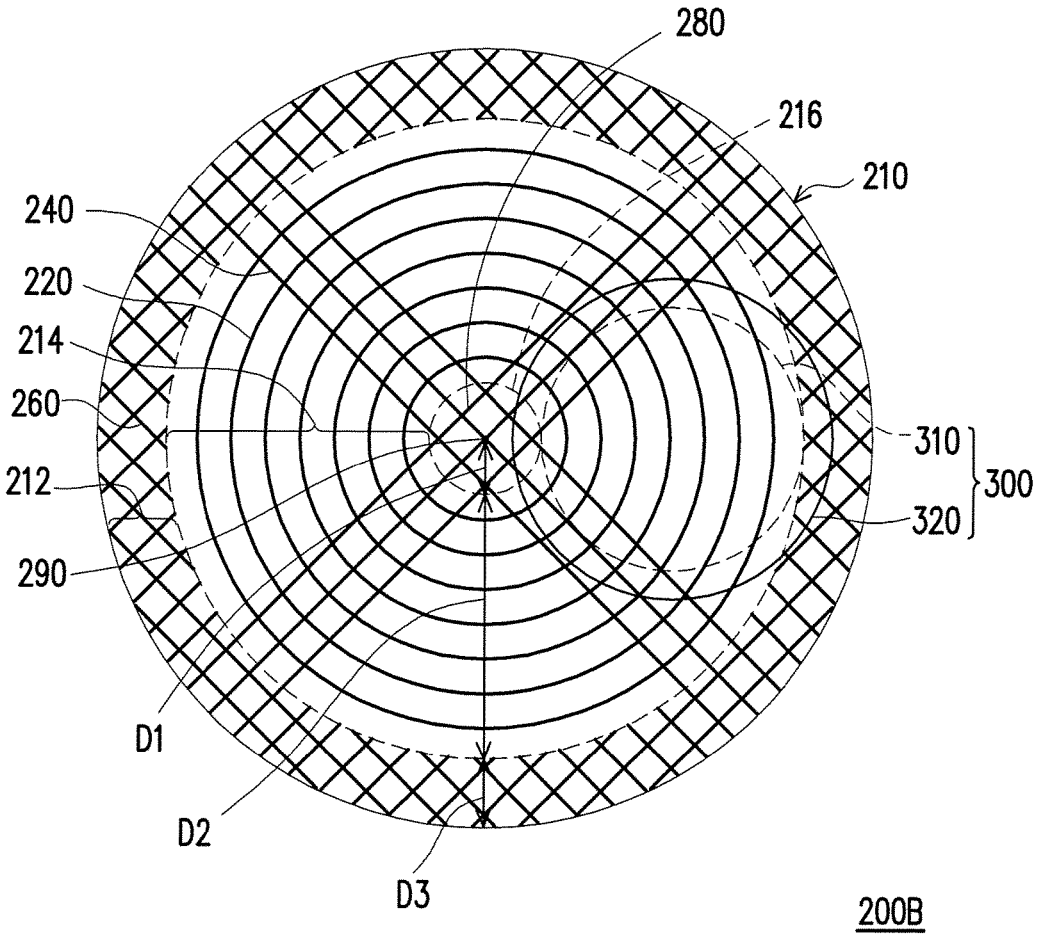
FIG. 5 is a schematic top view of a polishing pad and an object to be polished according to another embodiment of the invention.

The polishing pad 200A described above with reference to FIG. 3 is merely one of the embodiments of the invention, and the invention is not limited thereto. Thus, the polishing pad of the invention may be embodied in other ways. FIG. 5 is a schematic top view of the polishing pad and the object to be polished according to another embodiment of the invention. That is to say, the polishing pad 200A of the polishing system 1000 of FIG. 2 may be the polishing pad 200A of FIG. 3 or a polishing pad 200B of FIG. 5, for example, wherein the polishing pad 200A and the polishing pad 200B may be manufactured by using the same or different base materials, and the groove manufacturing methods may be the same or different. Nevertheless, the invention is not limited thereto.

The polishing pad 200B of the embodiment of FIG. 5 and the polishing pad 200A of the embodiment of FIG. 3 have similar structures. Therefore, identical components are denoted by the same reference numerals and detailed descriptions thereof are not repeated hereinafter. A difference between the polishing pad 200B of FIG. 5 and the polishing pad 200A of FIG. 3 is that the polishing pad 200B of FIG. 5 further includes a central groove 280 that is located in the central region 216 of the polishing layer 210. The central groove 280 includes a grid-shaped groove, which has a shape of a quadrilateral grid (e.g., square grid, rectangular grid, rhombic grid, and trapezoidal grid), a triangular grid, a polygonal grid, or a combination of the foregoing, for example. Nevertheless, the invention is not limited thereto. Specifically, the grid-shaped groove is formed by crossing two or more groups of grooves that are parallel to one another or not connected with one another, and the two or more groups of grooves that are parallel to one another or not connected with one another are lined grooves or curved grooves (e.g., arc grooves or annular grooves), for example. Nevertheless, the invention is not limited thereto. The grid-shaped groove shown in FIG. 5 has a shape formed by crossing two groups of parallel lined grooves that are perpendicular to each other, for example. Any of the central groove 280 may pass through the rotation center 290 or not depending on the actual requirements. For example, a part of the grooves of the central groove 280, as shown in FIG. 5, pass through the rotation center 290. In an embodiment, at least one radial extending groove 240 extends to the central region 216. The radial extending groove 240 is connected with the central groove 280, for example. Moreover, the radial extending groove 240 may be an extension of a portion of the grid-shaped groove of the central groove 280. For instance, the radial extending groove 240 shown in FIG. 5 includes four groups of parallel lined grooves, wherein extensions of the two groups of grooves spaced in the circumferential direction are connected in parallel in the central region 216, and extensions of the two groups of grooves adjacent in the circumferential direction are connected perpendicularly in the central region 216. In other words, the radial extending groove 240 of FIG. 5 not only extends to the peripheral region 212 but also extends to the central region 216. A portion of the extension lines (the middle groove of each group) of the radial extending grooves 240 in the central region 216 pass through the rotation center 290 while the other portions (peripheral two grooves of each group) do not pass through the rotation center 290.

Figure 6:
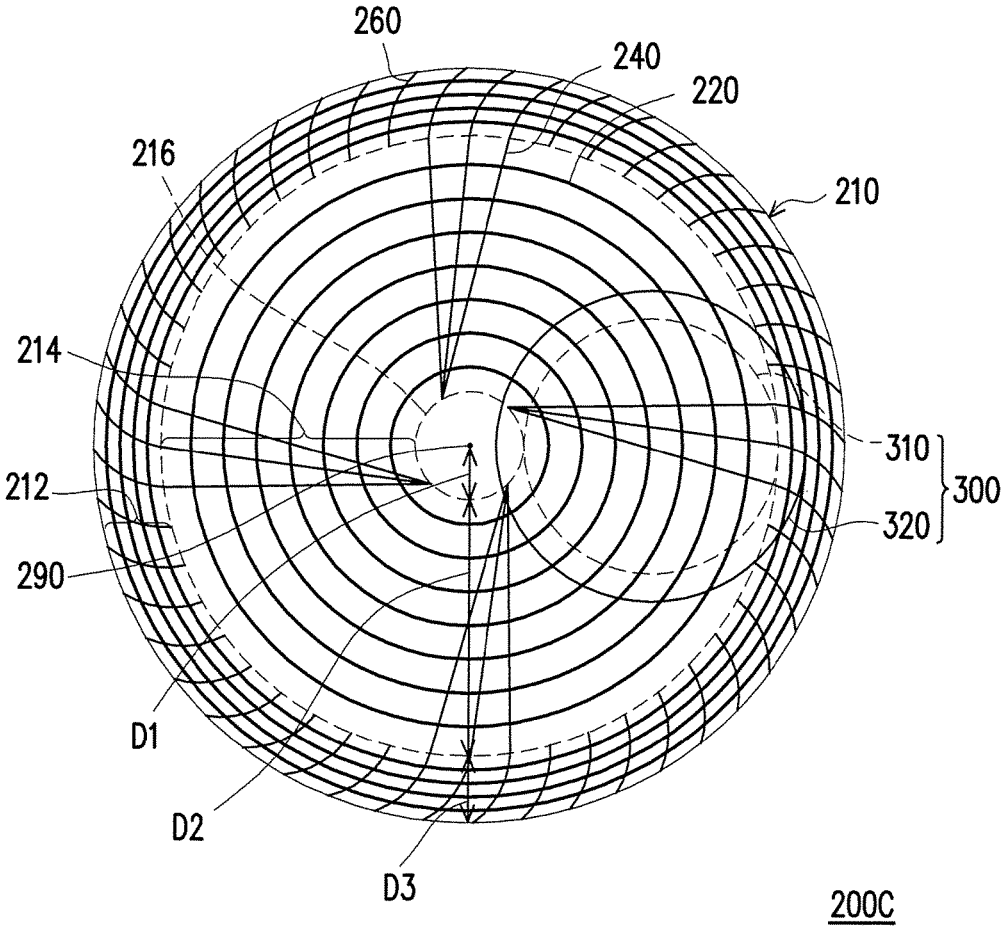
FIG. 6 is a schematic top view of a polishing pad and an object to be polished according to another embodiment of the invention.

A polishing pad 200C of the embodiment of FIG. 6 and the polishing pad 200B of the embodiment of FIG. 3 have similar structures. Therefore, identical components are denoted by the same reference numerals and detailed descriptions thereof are not repeated hereinafter. A difference between the structure of the polishing pad 200C of FIG. 6 and the polishing pad 200A of FIG. 3 is that the peripheral groove 260 of the polishing pad 200C of FIG. 6 is formed by crossing two or more arc grooves and two or more annular grooves, for example, and the peripheral groove 260 is a quadrilateral grid-shaped groove with curved edges. The arc grooves curve in a clockwise direction from inside to outside, but may also curve in a counterclockwise direction from inside to outside. At least one radial extending groove 240 of the polishing pad 200C of FIG. 6 includes four groups of lined grooves that are not parallel to one another, for example, wherein the radial extending grooves 240 that are not parallel to one another in each group are connected with one another on a side close to the central region 216, and virtual extension lines of the radial extension grooves 240 do not pass through the rotation center 290, for example. The radial extending groove 240 shown in FIG. 6 is a lined groove, for example. However, the radial extending groove 240 may also be a curved groove (e.g., arc), an irregular groove, or a combination of the foregoing.

In each of the embodiments of the invention described above, the at least one annular groove of the polishing layer includes a plurality of annular grooves arranged concentrically around the rotation center of the polishing pad, but the invention is not limited thereto. In some other embodiments, the center of a part or all of the at least one annular groove may not coincide with the rotation center of the polishing pad. Moreover, the at least one annular groove of the polishing layer may be an annular groove or annular grooves having multiple intersection points with the radius of the polishing pad, which may be one or multiple spiral annular grooves, for example. In addition, in each of the embodiments described above, the at least one radial extending groove of the polishing layer is a lined groove, for example, but the invention is not limited thereto. In some other embodiments, the peripheral groove and the at least one radial extending groove may be arc grooves, discontinuous grooves, irregular non-lined grooves, or a combination of the foregoing.

To conclude, the polishing pad of the invention has the central region, the peripheral region, and the main polishing region between the central region and the peripheral region in the polishing layer, and at least multiple annular grooves and at least one radial extending groove are disposed in the main polishing region while the peripheral groove is disposed in the peripheral region. Because the inner region of the object to be polished is in contact with the annular grooves and the radial extending groove of the polishing layer, and the outer region of the object to be polished is in contact with the annular grooves, the peripheral groove, and the radial extending groove of the polishing layer, the slurry has a different flow distribution so as to achieve a relatively uniform removal rate.

It will be apparent to those skilled in the art that various modifications and variations can be made to the disclosed embodiments without departing from the scope or spirit of the invention. In view of the foregoing, it is intended that the invention covers modifications and variations provided that they fall within the scope of the following claims and their equivalents.

What is claimed is:

1. A polishing pad, comprising:
- a polishing layer comprising a central region, a peripheral region, and a main polishing region located between the central region and the peripheral region;
- at least one annular groove located in the main polishing region of the polishing layer;
- a peripheral groove located in the peripheral region of the polishing layer and comprising a grid-shaped groove; and
- at least one radial extending groove located in the main polishing region of the polishing layer and connected with the at least one annular groove,
- wherein each groove of the peripheral groove that is not connected with the at least one radial extending groove comprises:
  - a first end point located on an outer side of the main polishing region and comprising an end surface; and
  - a second end point located on an outer side of the peripheral region and not comprising an end surface.

2. The polishing pad according to claim 1, wherein the polishing layer comprises a rotation center at a center position of the polishing layer, and the at least one annular groove is arranged concentrically around the rotation center.

3. The polishing pad according to claim 1, wherein the grid-shaped groove of the peripheral groove has a shape of a square grid, a rectangular grid, a rhombic grid, a trapezoidal grid, a triangular grid, a polygonal grid, or a combination of the foregoing.

4. The polishing pad according to claim 1, wherein the at least one radial extending groove extends to the peripheral region and is connected with the peripheral groove.

5. The polishing pad according to claim 4, wherein the at least one radial extending groove is an extension of a portion of the grid-shaped groove of the peripheral groove.

6. The polishing pad according to claim 1, further comprising a central groove located in the central region of the polishing layer and comprising a grid-shaped groove.

7. The polishing pad according to claim 6, wherein the grid-shaped groove of the central groove has a shape of a square grid, a rectangular grid, a rhombic grid, a trapezoidal grid, a triangular grid, a polygonal grid, or a combination of the foregoing.

8. The polishing pad according to claim 6, wherein the at least one radial extending groove extends to the central region and is connected with the central groove.

9. The polishing pad according to claim 6, wherein the at least one radial extending groove is an extension of a portion of the grid-shaped groove of the central groove.

10. The polishing pad according to claim 1, wherein in a radial direction of the polishing layer, the central region has a first width, the main polishing region has a second width, and the peripheral region has a third width.

11. The polishing pad according to claim 10, wherein:
- the first width is 5%-25% of a radius of the polishing layer,
- the second width is 50%-90% of the radius of the polishing layer, and
- the third width is 5%-25% of the radius of the polishing layer.

12. A polishing system, comprising:
- a polishing pad, comprising:
- a polishing layer comprising a central region, a peripheral region, and a main polishing region located between the central region and the peripheral region;
- at least one annular groove located in the main polishing region of the polishing layer;
- a peripheral groove located in the peripheral region of the polishing layer and comprising a grid-shaped groove; and
- at least one radial extending groove located in the main polishing region of the polishing layer and connected with the at least one annular groove, wherein each groove of the peripheral groove that is not connected with the at least one radial extending groove comprises:
  - a first end point located on an outer side of the main polishing region and comprising an end surface; and
  - a second end point located on an outer side of the peripheral region and not comprising an end surface; and
- an object to be polished disposed on the polishing pad and comprising an inner region and an outer region encircling the inner region, wherein in a polishing process, the inner region of the object to be polished is in contact with the at least one annular groove and the at least one radial extending groove of the polishing layer, and the outer region of the object to be polished is in contact with the at least one annular groove, the peripheral groove, and the at least one radial extending groove of the polishing layer.

13. The polishing system according to claim 12, wherein the polishing layer comprises a rotation center at a center position of the polishing layer, and the at least one annular groove is arranged concentrically around the rotation center.

14. The polishing system according to claim 12, wherein the grid-shaped groove of the peripheral groove has a shape of a square grid, a rectangular grid, a rhombic grid, a trapezoidal grid, a triangular grid, a polygonal grid, or a combination of the foregoing.

15. The polishing system according to claim 12, wherein the at least one radial extending groove extends to the peripheral region and is connected with the peripheral groove.

16. The polishing system according to claim 15, wherein the at least one radial extending groove is an extension of a portion of the grid-shaped groove of the peripheral groove.

17. The polishing system according to claim 12, further comprising a central groove located in the central region of the polishing layer and comprising a grid-shaped groove.

18. The polishing system according to claim 17, wherein the grid-shaped groove of the central groove has a shape of a square grid, a rectangular grid, a rhombic grid, a trapezoidal grid, a triangular grid, a polygonal grid, or a combination of the foregoing.

19. The polishing system according to claim 17, wherein the at least one radial extending groove extends to the central region and is connected with the central groove.

20. The polishing system according to claim 17, wherein the at least one radial extending groove is an extension of a portion of the grid-shaped groove of the central groove.

21. The polishing system according to claim 12, wherein in a radial direction of the polishing layer, the central region has a first width, the main polishing region has a second width, and the peripheral region has a third width.

22. The polishing system according to claim 21, wherein:

the first width is 5%-25% of a radius of the polishing layer, the second width is 50%-90% of the radius of the polishing layer, and the third width is 5%-25% of the radius of the polishing layer.

23. A polishing method, comprising:

providing a polishing pad as claimed in claim 1;

disposing an object to be polished on the polishing pad, wherein the object to be polished comprises an inner region and an outer region encircling the inner region; and applying a pressure on the object to be polished to press the object to be polished against the polishing pad to perform a polishing process, in which the object to be polished is moving relative to the polishing pad in the polishing process.

24. The polishing method according to claim 23, wherein in the polishing process, the object is polished along a back-and-forth swinging direction, wherein when the object to be polished swings outward away from the rotation center, the outer region of the object to be polished corresponds to the peripheral region of the polishing layer; and when the object to be polished swings inward toward the rotation center, the outer region of the object to be polished corresponds to the central region of the polishing layer.

25. The polishing method according to claim 23, wherein in the polishing process, the object to be polished does not have a back-and-forth swinging direction, such that the inner region of the object to be polished corresponds to the main polishing region of the polishing layer, and the outer region of the object to be polished corresponds to the peripheral region of the polishing layer.

* * * * *